US006416370B1

(12) United States Patent
Bland et al.

(10) Patent No.: US 6,416,370 B1
(45) Date of Patent: Jul. 9, 2002

(54) WATERCRAFT HYDRAULIC APPARATUS

(75) Inventors: Gerald Francis Bland; Arthur R. Ferguson, both of Glenview; Stephen R. Johnson, Waukegan, all of IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/730,720

(22) Filed: Dec. 6, 2000

(51) Int. Cl.[7] ..... A63B 31/11
(52) U.S. Cl. ..... 440/61; 114/150
(58) Field of Search ..... 440/5, 61, 84; 114/150, 144 R

(56) References Cited

U.S. PATENT DOCUMENTS

| | | | | |
|---|---|---|---|---|
| 3,631,833 A | | 1/1972 | Shimanckas | |
| 3,722,455 A | | 3/1973 | Carpenter | |
| 3,839,986 A | | 10/1974 | Meyer et al. | |
| 3,885,517 A | | 5/1975 | Borst et al. | |
| 3,915,111 A | * | 10/1975 | Buddrus | 440/61 |
| 3,929,089 A | | 12/1975 | Lambrecht et al. | |
| 3,962,955 A | | 6/1976 | Borst et al. | |
| 3,983,835 A | | 10/1976 | Hall | |
| 3,999,502 A | | 12/1976 | Mayer | |
| 4,050,359 A | | 9/1977 | Mayer | |
| 4,052,952 A | | 10/1977 | Hale et al. | |
| 4,064,824 A | | 12/1977 | Hall et al. | |
| 4,096,820 A | | 6/1978 | Hall | |
| 4,362,514 A | | 12/1982 | Blanchard | |
| 4,363,629 A | | 12/1982 | Hall et al. | |
| 4,391,592 A | | 7/1983 | Hundertmark | |
| 4,395,239 A | | 7/1983 | Hall et al. | |
| 4,406,632 A | | 9/1983 | Blanchard | |
| 4,431,422 A | | 2/1984 | Hall | |
| 4,490,120 A | | 12/1984 | Hundertmark | |
| 4,498,871 A | | 2/1985 | Hall et al. | |
| 4,504,237 A | | 3/1985 | Blanchard | |
| 4,504,238 A | | 3/1985 | Neisen | |
| 4,544,362 A | * | 10/1985 | Arneson | 440/61 |
| 4,551,105 A | | 11/1985 | Hall | |
| 4,568,292 A | | 2/1986 | Hall | |
| 4,578,039 A | | 3/1986 | Hall | |
| 4,595,370 A | | 6/1986 | Small | |
| 4,605,375 A | | 8/1986 | Ferguson | |
| 4,615,290 A | | 10/1986 | Hall | |
| 4,632,049 A | | 12/1986 | Hall et al. | |
| 4,642,058 A | | 2/1987 | Sullivan | |
| 4,645,464 A | | 2/1987 | Rawlings | |
| 4,659,315 A | | 4/1987 | Bland et al. | |

(List continued on next page.)

*Primary Examiner*—Stephen Avila
(74) *Attorney, Agent, or Firm*—Timothy J. Ziolkowski; Cook & Franke SC

(57) ABSTRACT

A common fluid pressure supply apparatus (40) for a watercraft (10). A fluid interconnection apparatus interconnects the hydraulic fluid circuits operating the hydraulic transmission (18), power steering (30), and tilt-trim function (34) for an inboard/outboard stem drive (20) watercraft. A single fill vessel (104), oil cooler (82), and filter (126) are utilized for the common fluid pressure supply apparatus. The fluid interconnection apparatus may include the transmission housing reservoir (42).

38 Claims, 2 Drawing Sheets

U.S. PATENT DOCUMENTS

| | | | |
|---|---|---|---|
| 4,682,759 | A | 7/1987 | Hall et al. |
| 4,687,449 | A | 8/1987 | Fenrich |
| 4,698,035 | A | 10/1987 | Ferguson |
| 4,710,141 | A | 12/1987 | Ferguson |
| 4,813,897 | A | 3/1989 | Newman et al. |
| 4,836,810 | A | 6/1989 | Entringer |
| 4,836,812 | A | 6/1989 | Griffiths |
| 4,846,742 | A | 7/1989 | Bertram et al. |
| 4,892,494 | A | 1/1990 | Ferguson |
| 4,925,411 | A | 5/1990 | Burmeister et al. |
| 4,957,457 | A | 9/1990 | Probst et al. |
| 5,030,147 | A | 7/1991 | Binversie et al. |
| 5,049,098 | A | 9/1991 | Binversie et al. |
| 5,074,193 | A | 12/1991 | Hundertmark |
| 5,137,480 | A | 8/1992 | Binversie et al. |
| 5,176,093 | A | 1/1993 | Binversie et al. |
| 5,241,894 | A | 9/1993 | Hundertmark |
| 5,328,396 | A | 7/1994 | Hayasaka |
| 5,392,690 | A | 2/1995 | Hundertmark |
| 5,707,263 | A | 1/1998 | Eick et al. |

* cited by examiner

WATERCRAFT HYDRAULIC APPARATUS

BACKGROUND OF THE INVENTION

This invention relates generally to the field of recreational watercraft, and more particularly to the hydraulic system for a watercraft, and specifically to a common hydraulic system for providing pressurized fluid to a hydraulic transmission, a power steering unit, and a trim unit of a watercraft.

Attention is directed to the following U.S. Patents which describe the various

| | | |
|---|---|---|
| Borst | 3,885,517 | May 27, 1975 |
| Lambrecht | 3,929,089 | Dec. 30, 1975 |
| Borst | 3,962,955 | Jun. 15, 1976 |
| Hall | 4,064,824 | Dec. 27, 1977 |
| Blanchard | 4,362,514 | Dec. 07, 1982 |
| Hall | 4,431,422 | Feb. 14, 1984 |
| Hall | 4,551,105 | Nov. 05, 1985 |
| Ferguson | 4,605,375 | Aug. 12, 1986 |
| Hall | 4,615,290 | Oct. 07, 1986 |
| Sullivan | 4,642,058 | Feb. 10, 1987 |
| Bland | 4,659,315 | Apr. 21, 1987 |
| Ferguson | 4,698,035 | Oct. 06, 1987 |

Recreational watercraft are generally propelled by an internal combustion engine mounted either inboard to the watercraft or supported outboard on the transom of the watercraft. An inboard engine may be connected to the propeller via a stern drive unit passing through the transom of the watercraft. It is known to provide a power steering system for both inboard and outboard watercraft. Such power steering systems typically include one or more hydraulic cylinders selectively activated by being provided with a pressurized hydraulic fluid via a power steering cylinder valve that is responsive to the movement of a steering wheel. The power steering hydraulic cylinder may be connected to a steering arm which pivots the drive unit about a generally vertical axis, thereby controlling the direction of thrust provided by the propeller. The power steering cylinder valve controls the supply of pressurized hydraulic fluid to the hydraulic cylinder. The operator of the watercraft thus needs only to exert enough effort to operate the power steering cylinder valve and not the total effort required to actually rotate the steering arm. A cooler may be provided to remove heat from the hydraulic fluid generated by the action of the power steering pump.

It is also known to provide a power trim system for both inboard and outboard drive units. A power trim system is used to pivot the propeller about a generally horizontal axis to adjust the vertical drive angle of the propeller with respect to the watercraft. Such rotation of the propeller in the vertical direction permits the angle of thrust to be optimized for both on-plane and off-plane operation of the watercraft. To accomplish the power trim function, pressurized hydraulic fluid may be provided by a reversible pump to a lift cylinder to raise or lower the bottom portion of the drive unit. The trim system may include the capability to lift the propeller completely or nearly out of the water for operation in shallow water and for removal of the watercraft from the water. Such systems are referred to as tilt-trim systems and often include separate hydraulic cylinders for performing the tilt and the trim functions.

It is also known to utilize a hydraulic transmission with an inboard/outboard watercraft. Such transmissions utilize pressurized hydraulic fluid to actuate a shifting mechanism and also to provide lubrication within the transmission. The flow of the hydraulic fluid and the power to operate the shift mechanism is provided by a transmission fluid pump through one or more transmission valves. A cooler is usually provided to maintain the temperature of the transmission fluid below an upper limit in order to protect the transmission components and to prevent premature degradation of the transmission fluid.

Typically, each of the hydraulic systems in a watercraft is a self contained unit, including a reservoir for storing hydraulic fluid, a pump connected to the reservoir for pressurizing the hydraulic fluid, and appropriate valves and interconnecting typing. Each system is provided with both fill and vent connections. The hydraulic fluid in the power steering and hydraulic transmission circuits may become heated due to the operation of the respective pump, and individual coolers are normally provided to remove heat from each of these fluid systems. The fluid level in each of the hydraulic systems must be checked periodically to ensure that an adequate supply of hydraulic fluid is available for operation of the watercraft. Access to the various fluid fill locations and associated dipstick level indicators is often restricted, causing some watercraft operators to forego the appropriate schedule for fluid fill verification. As a result, equipment damage and/or unsafe operating conditions may result from the operation of the watercraft with an inadequate hydraulic fluid supply in one or more of the hydraulic systems.

BRIEF SUMMARY OF THE INVENTION

Thus there is a particular need for a watercraft having hydraulic systems that are easy to inspect for proper fill level. There is also a need for a simple and less expensive hydraulic fluid supply apparatus for the various hydraulic systems on-board a watercraft. Furthermore, there is a need for a watercraft that is less susceptible to damage resulting from the operation of the watercraft with an inadequate hydraulic fluid supply level in one or more of its hydraulic systems.

Accordingly, a common fluid pressure supply apparatus is described herein for a watercraft having a drive unit including a hydraulic transmission, a hydraulically operated power steering apparatus attached to the drive unit for steering the water craft, and a hydraulically operated trim apparatus attached to the drive unit for raising and lowering the drive unit with respect to the watercraft. The watercraft includes a transmission housing reservoir for containing hydraulic fluid; a transmission pump having an inlet in fluid communication with the transmission housing reservoir and an outlet for providing pressurized hydraulic fluid to the hydraulic transmission, and a fluid return path between the hydraulic transmission and the transmission housing reservoir; a power steering pump reservoir having an inlet in fluid communication with the transmission housing reservoir; a power steering pump having an inlet in fluid communication with the power steering pump reservoir and an outlet for providing pressurized hydraulic fluid to the power steering apparatus, and a fluid return path between the power steering apparatus and the transmission housing reservoir; a trim pump reservoir having an inlet in fluid communication with the transmission housing reservoir; a trim pump having an inlet in fluid communication with the trim pump reservoir and an outlet for providing pressurized hydraulic fluid to the trim apparatus, and a fluid return path between the trim apparatus and one of the trim reservoir and the transmission housing reservoir. The fluid pressure supply apparatus may further include a fill vessel having a low point outlet in fluid communication with each of the power steering pump reservoir and the trim pump reservoir, and having a high point outlet in fluid communication with each of the transmission housing reservoir, the power steering pump reservoir and the trim pump reservoir.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
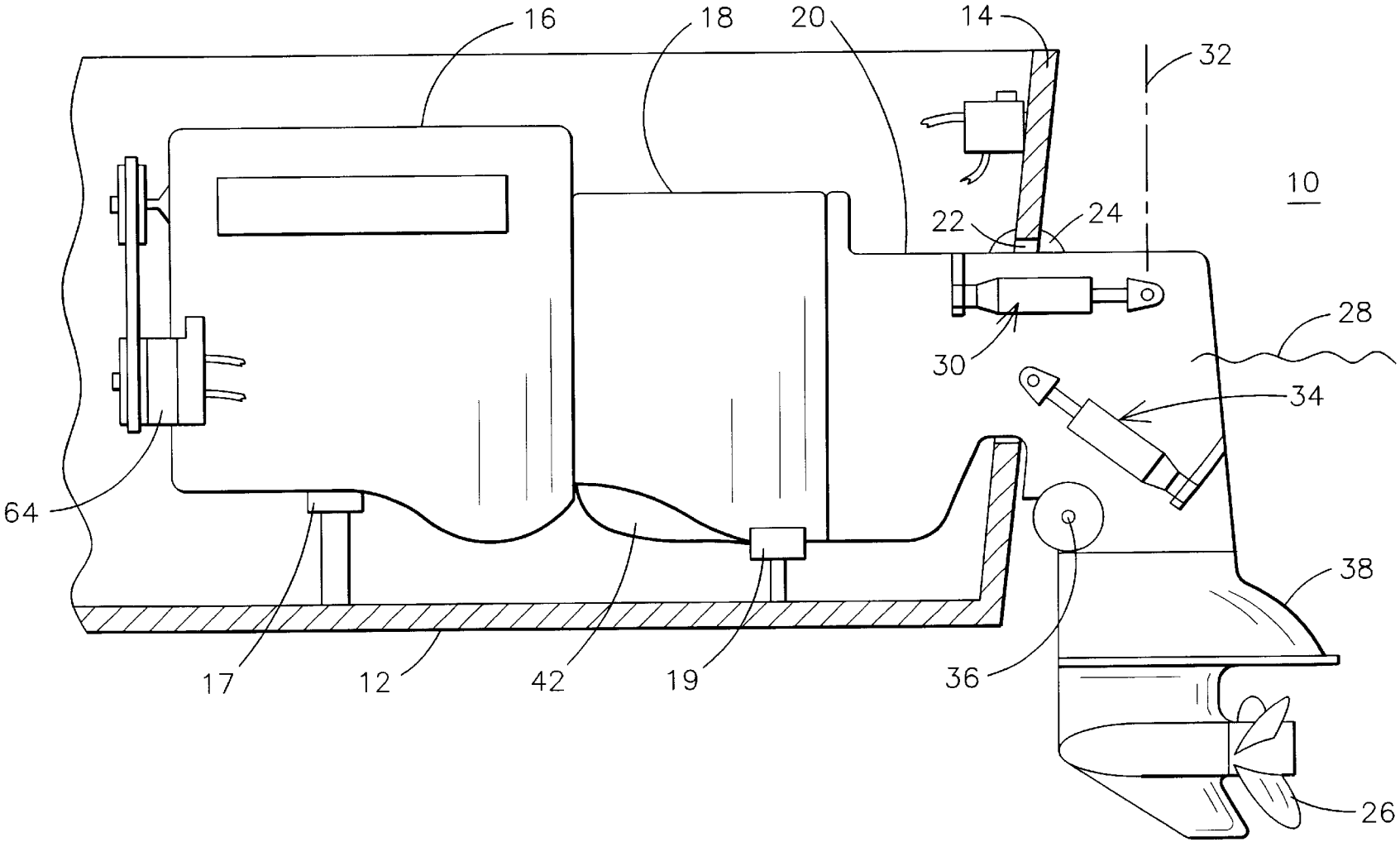
FIG. 1 is a partial side elevational view of a watercraft employing the invention.

FIG. 1 illustrates a watercraft 10 including a hull 12 having a transom 14. An internal combustion engine 16 is disposed in the hull 12 and supported by one or more motor mounts 17. A hydraulic transmission 18 is connected to the engine 16 for the purpose of transmitting mechanical energy produced by the engine 16 through a drive shaft (not shown) having a plurality of gearing ratios. Transmission 18 is also disposed within hull 12 and may be supported by one or more transmission mounts 19. A stern drive apparatus 20 is connected to the transmission 18 and is disposed through an opening 22 formed in the transom 14. As is known in the art, stern drive apparatus 20 is used to transmit the mechanical energy from the engine 16 and transmission 18 to a propeller 26 located external to the hull 12 and below a waterline 28. Propeller 26 is rotatingly connected to the stern drive apparatus 20 at the end of a drive shaft (not shown). A steering apparatus 30 is connected to the stern drive apparatus 20 for rotating the propeller 26 about a vertical axis 32 for steering the watercraft 10. As is known in the art, the steering apparatus 30 may include one or more hydraulic actuators provided with pressurized hydraulic fluid and responsive to steering inputs provided by an operator through a steering wheel. A trim apparatus 34 is also connected to the stem drive apparatus 20 for raising an lowering the propeller 26 about a horizontal axis 36 relative to hull 12. The trim apparatus 34 is useful for adjusting the angle of thrust provided by the propeller 26 in a vertical direction in order to optimize the efficiency of the operation of the watercraft 10. The term trim apparatus as used herein is meant to include a tilt-trim apparatus for embodiments where the range of vertical motion of the propeller 26 is sufficient to lift propeller 26 and lower portion 38 of stem drive apparatus 20 to a raised position near or above the water line 28.

Each of the transmission 18, steering apparatus 30, and trim apparatus 34 is a hydraulic system operable with pressurized hydraulic fluid. These three pressurized hydraulic fluid circuits are interconnected by a fluid interconnection apparatus to form a common fluid pressure supply apparatus 40 as will be described more fully with respect to FIG. 2. Such an apparatus simplifies the tasks of maintaining proper conditioning of the hydraulic fluid and maintaining a proper fluid level in each of the plurality of hydraulic systems.

Figure 2:
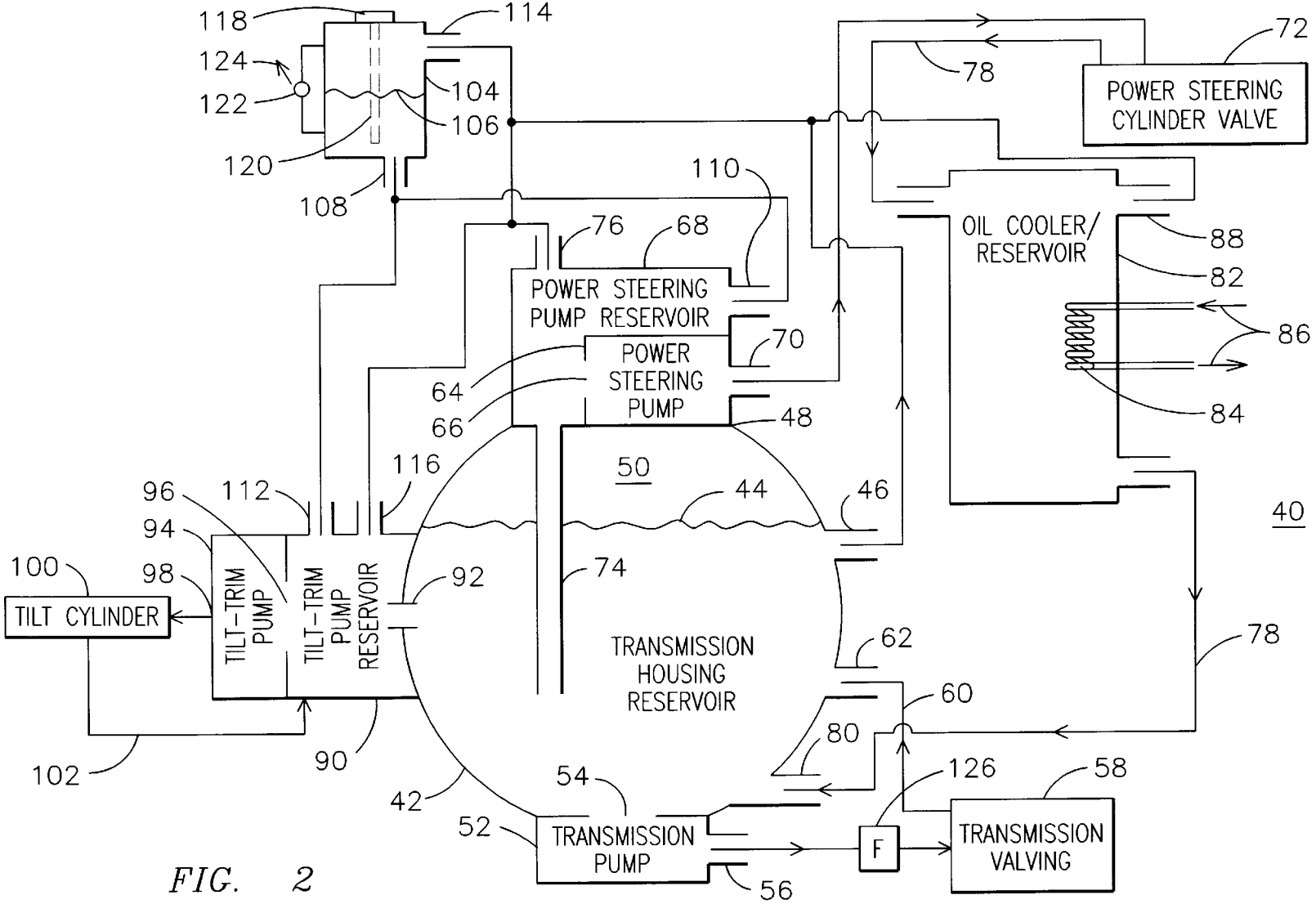
FIG. 2 is a schematic illustration of the hydraulic fluid supply system of the watercraft of FIG. 1.

FIG. 2 is a schematic illustration of the common fluid pressure supply apparatus 40 utilized in the watercraft 10 of FIG. 1. The common fluid pressure supply apparatus 40 includes a fluid interconnection apparatus, which in the embodiment of FIG. 2 includes a transmission housing reservoir 42 that is formed to be integral with the casing of transmission 18. The transmission housing reservoir 42 contains a volume of hydraulic fluid 44 that is exchanged among the plurality of hydraulic circuits of the water craft. A vent connection 46 is provided into transmission housing 42 below a high point 48 of the reservoir 42 in order to provide for a trapped air space 50 within the transmission 18. Such a trapped air space 50 is known in the art to be necessary to accommodate the foaming of the hydraulic fluid 44 during the operation of hydraulic transmission 18. A transmission pump 52 having an inlet 54 in fluid communication with the transmission housing reservoir 42 is operable to provide pressurized hydraulic fluid through an outlet 56 to one or more transmission valves 58. A filter 126 may be interposed between the transmission pump 52 and transmission valves 58. A fluid return path 60 is provided between the transmission valve 58 and a return inlet 62 formed in the transmission housing reservoir 42. Fluid return path 60 may be a conduit located outside the transmission casing or may be formed as fluid passages within the transmission casing.

A power steering pump 64 having an inlet 66 in fluid communication with a power steering pump reservoir 68 is operable to provide pressurized hydraulic fluid through an outlet 70 to a power steering cylinder valve 72. The power steering pump 64 is operable to draw hydraulic fluid 44 from the transmission housing reservoir 42, such as through an inlet 74 of power steering pump reservoir 68. Power steering pump reservoir 68 is also provided with a vent connection 76 located at a high point of power steering pump reservoir 68. A fluid return path 78 is provided to return the hydraulic fluid from power steering cylinder valve 72 to a return inlet 80 of transmission housing reservoir 42. The interconnections between the power steering pump 64 and power steering cylinder valve 72 as well as the fluid return path 78 may be any form of known hydraulic fluid line, such as stainless steel tubing or flexible hydraulic line. Power steering pump 64 may be powered by a mechanical connection to engine 16, such as by a belt drive, or it may be driven by an electric motor. One may also appreciate that return inlets 62, 80 may be formed as a single penetration through transmission housing reservoir 42.

A trim pump reservoir 90 is in fluid communication with transmission housing reservoir 42 through an inlet 92. A trim pump 94 having an inlet 96 in fluid communication with the trim pump reservoir 90 has an outlet 98 for providing pressurized hydraulic fluid to a trim cylinder 100. A fluid return path 102 is provided to return the hydraulic 44 to the trim reservoir 90. In an alternative embodiment, the fluid return path 102 may connect into the transmission housing reservoir 42. The trim reservoir is provided with both an inlet fill connection 112 and a vent connection 116.

While the embodiment illustrated herein provides an interconnection among three hydraulic fluid circuits, i.e. the power steering, the tilt-trim and the hydraulic transmission, other embodiments may include different combinations of hydraulic circuits. For example, some water craft do not have hydraulic transmissions. For such applications only the power steering and tilt-trim hydraulic circuits may be interconnected.

Advantageously, a hydraulic fluid cooler 82 is provided as part of the power steering apparatus 30. Cooler 82 is in fluid communication with the outlet 70 of power steering pump 64 and is operable to remove heat from the hydraulic fluid 44. Cooler 82 may be of any design known in the art, and may include one or more cooling coils 84 operable to transfer heat from the hydraulic fluid located on a shell side to a cooling water supply such as lake water 86 being pumped through a tube side of coils 84. As a result of the intermixing of hydraulic fluid 44 from the transmission 18, steering apparatus 30, and trim apparatus 34, one may appreciate that a single cooler 82 is operable to provide cooling for all three hydraulic systems. A filter may be disposed downstream of the outlet 70 of the power steering pump 64 to supplement or to replace filter 126, since in either location there is a continuous recirculation of the hydraulic fluid 44 from transmission housing reservoir 42. Accordingly, by providing a single cooler or filter in just one of the hydraulic circuits, the hydraulic fluid for each of the circuits may be cooled/filtered. Optionally, a vent connection 88 may be provided on the shell side of cooler 82.

One may appreciate that the cooler 82 and filter 126 are just two types of fluid conditioning devices that may be included in the common fluid pressure supply apparatus 40. Other known types of conditioning devices may be used alone or in combination with cooler 82 and/or filter 126. Such conditioning devices may include a device for controlling the level of additives in the hydraulic fluid, for controlling the pH of the hydraulic fluid, for conducting a nondestructive examination of the hydraulic fluid to determine one or more quality parameters, etc. Advantageously, by including one such device in any one or more of the plurality of hydraulic circuits interconnected by the common transmission housing reservoir 42, conditioning may be accomplished in the entire volume of hydraulic fluid used in each hydraulic circuit.

The fluid interconnection apparatus illustrated in FIG. 2 includes a common high point fill vessel 104. Fill vessel 104 may be a translucent plastic bottle attached to hull 12. Fill vessel is interconnected to each of the transmission 18, steering apparatus 30, and trim apparatus 34. A level 106 of hydraulic fluid 44 is maintained within the fill vessel 104. Fill vessel 104 has a low point outlet 108 in fluid communication with a fill inlet 110 of the power steering pump reservoir 68, and with a fill inlet 112 of the trim pump reservoir 90 for providing hydraulic fluid thereto and to the transmission reservoir 42 through power steering pump reservoir 68. Fill vessel 104 also contains a high point vent outlet 114 in fluid communication with the vent connection 76 of power steering pump reservoir 68, vent connection 116 of trim pump reservoir 90, and vent connection 46 of transmission housing reservoir 42. High point outlet 114 may also be connected with the optional vent connection 88 of cooler 82. High point outlet 114 is vented to the ambient atmosphere. A cap 118 having an attached dipstick 120 may be utilized as an indicator of the level 106 of hydraulic fluid in fill vessel 104. This single level indication of hydraulic fluid 44 within fill vessel 104 provides assurance that each of the three hydraulic systems contains an adequate supply of hydraulic fluid 44. By locating a common fill vessel 104 at a convenient location on the water craft that is accessible by the water craft operator, the task of maintaining proper hydraulic levels in each of the plurality of hydraulic circuits is greatly simplified.

A sensor 122 may be adapted to provide a signal 124 corresponding to the level 106 of hydraulic fluid 44 contained in a fill vessel 104. Sensor 122 may be any type known in the art for providing signal 124. It may be appreciated that fill vessel 104 may be disposed at a convenient high point location within watercraft 10 to allow for the operator to check the level 106 of the hydraulic fluid and to add additional hydraulic fluid as necessary. By providing a single fill vessel 104, the task of maintaining a proper level of hydraulic fluid in each of the transmission 18, steering apparatus 30, and trim apparatus 34, is greatly simplified for the operator. Furthermore, by interconnection the three hydraulic systems, a single cooler 82 and a single filter 126 may be located within the common fluid pressure supply apparatus 40 for regulating the temperature and cleanliness of the hydraulic fluid 44 of all three systems. Furthermore, signal 124 may be utilized in a control system for avoiding undesirable operating conditions, such as for limiting the speed of engine operation when the hydraulic fluid level drops below a predetermined level.

While the preferred embodiments of the present invention have been shown and described herein, it will be obvious that such embodiments are provided by way of example only. Numerous variations, changes and substitutions will occur to those of skill in the arts without departing from the invention herein. Accordingly, it is intended that the invention be limited only by the spirit and scope of the appendant claims.

We claim as our invention:

1. A fluid pressure supply apparatus for a watercraft comprising:

a first reservoir for containing hydraulic fluid;

a transmission pump having an inlet in fluid communication with the first reservoir and an outlet for providing pressurized hydraulic fluid to a hydraulic transmission, and a fluid return path between the hydraulic transmission and the first reservoir;

a second reservoir having an inlet in fluid communication with the first reservoir;

a power steering pump having an inlet in fluid communication with the second reservoir and an outlet for providing pressurized hydraulic fluid to a power steering apparatus, and a fluid return path between the power steering apparatus and the first reservoir;

a third reservoir having an inlet in fluid communication with the first reservoir;

a trim pump having an inlet in fluid communication with the third reservoir and an outlet for providing pressurized hydraulic fluid to a trim apparatus, and a fluid return path between the trim apparatus and one of the third reservoir and the first reservoir.

2. The fluid pressure supply apparatus of claim 1, further comprising a cooler in fluid communication with the power steering pump outlet for removing heat from the hydraulic fluid.

3. The fluid pressure supply apparatus of claim 1, further comprising a fill vessel having a low point outlet in fluid communication with each of the second reservoir and the third reservoir, and having a high point outlet in fluid communication with each of the first reservoir, the second reservoir and the third reservoir.

4. The fluid pressure supply apparatus of claim 3 further comprising:

a cooler in fluid communication with the power steering pump outlet for removing heat from the hydraulic fluid; and the fill vessel high point outlet being in fluid communication with the cooler.

5. The fluid pressure supply apparatus of claim 3 further comprising a level sensor adapted to provide a signal corresponding to the level of hydraulic fluid contained in the fill vessel.

6. A watercraft comprising:

a hull having a transom;

an engine disposed in the hull;

a hydraulic transmission connected to the engine;

a stem drive apparatus connected to the transmission and sealingly disposed through an opening formed in the transom;

a propeller connected to the stem drive apparatus;

a steering apparatus connected to the stem drive apparatus for moving the propeller about a vertical axis for steering the watercraft;

a trim apparatus connected to the stem drive apparatus for pivoting the propeller relative to the hull;

the transmission further comprising a first reservoir for containing hydraulic fluid, and a transmission pump having an inlet in fluid communication with the first reservoir and an outlet for providing pressurized hydraulic fluid to a transmission valve, and a fluid return path between the transmission valve and the transmission housing reservoir;

a second reservoir having an inlet in fluid communication with the first reservoir;

the power steering apparatus further comprising a power steering pump having an inlet in fluid communication with the second reservoir and an outlet for providing pressurized hydraulic fluid to a power steering cylinder valve, and a fluid return path between the power steering cylinder valve and the first reservoir;

a third reservoir having an inlet in fluid communication with the first reservoir;

a trim pump having an inlet in fluid communication with the third reservoir and an outlet for providing pressurized hydraulic fluid to a trim cylinder, and a fluid return path between the trim cylinder and one of the third reservoir and the first reservoir.

7. The watercraft of claim 6 wherein the power steering pump is powered by a mechanical connection to the engine.

8. The watercraft of claim 6 wherein the power steering pump is powered by an electric motor.

9. A marine power unit comprising:

an engine;

a hydraulic transmission connected to the engine;

a stern drive apparatus connected to the transmission;

a propeller connected to the stem drive apparatus;

a steering apparatus connected to the stern drive apparatus for rotating the propeller about a vertical axis for steering the watercraft;

a trim apparatus connected to the stem drive apparatus for raising and lowering the propeller about a horizontal axis;

the transmission further comprising a first reservoir for containing hydraulic fluid, and a transmission pump having an inlet in fluid communication with the first reservoir and an outlet for providing pressurized hydraulic fluid to a transmission valve, and a fluid return path between the transmission valve and the first reservoir;

a second reservoir having an inlet in fluid communication with the first reservoir;

the steering apparatus further comprising a power steering pump having an inlet in fluid communication with the second reservoir and an outlet for providing pressurized hydraulic fluid to a power steering cylinder valve, and a fluid return path between the power steering cylinder valve and the first reservoir;

a third reservoir having an inlet in fluid communication with the first reservoir;

a trim pump having an inlet in fluid communication with the third reservoir and an outlet for providing pressurized hydraulic fluid to a trim cylinder, and a fluid return path between the trim cylinder and one of the third reservoir and the first reservoir.

10. A marine power unit comprising:

an engine;

a hydraulic transmission connected to the engine;

a stem drive apparatus connected to the transmission;

a propeller connected to the stem drive apparatus;

a steering apparatus connected to the stem drive apparatus for rotating the propeller about a vertical axis for steering the watercraft;

a trim apparatus connected to the stem drive apparatus for pivoting the propeller about a horizontal axis;

the transmission further comprising a first reservoir for containing hydraulic fluid, and a transmission pump having an inlet in fluid communication with the first reservoir and an outlet for providing pressurized hydraulic fluid to a transmission valve, and a fluid return path between the transmission valve and the first reservoir;

the steering apparatus further comprising a power steering pump having an inlet in fluid communication with the first reservoir and an outlet for providing pressurized hydraulic fluid to a power steering cylinder valve, and a fluid return path between the power steering cylinder valve and the first reservoir;

a trim pump having an inlet in fluid communication with the first reservoir and an outlet for providing pressurized hydraulic fluid to a trim cylinder, and a fluid return path between the trim cylinder and the first reservoir.

11. In a water craft having more than two hydraulic circuits for providing pressurized hydraulic fluid to more than two hydraulic devices, a fluid interconnection apparatus in fluid communication with each of the more than two hydraulic circuits for providing an exchange of hydraulic fluid among the more than two hydraulic circuits.

12. The apparatus of claim 11 wherein the fluid interconnection apparatus comprises a transmission housing.

13. The apparatus of claim 11 further comprising a fluid conditioning device for conditioning the hydraulic fluid exchanged among the more than two hydraulic circuits.

14. The apparatus of claim 13 wherein the fluid conditioning device comprises a cooler.

15. The apparatus of claim 13 wherein the fluid conditioning device comprises a filter.

16. The apparatus of claim 11 further comprising a common fill vessel in fluid communication with each of the more than two hydraulic circuits.

17. The apparatus of claim 16 further comprising a sensor adapted to provide a signal responsive to a level of hydraulic fluid in the common fill vessel.

18. A pressurized fluid supply apparatus for a water craft comprising:

a reservoir for containing a volume of hydraulic fluid, the reservoir comprising a portion of a transmission housing;

a first hydraulic circuit in fluid communication with the reservoir for providing hydraulic fluid to a power steering device;

a second hydraulic circuit in fluid communication with the reservoir for providing hydraulic fluid to a tilt-trim device;

a third hydraulic circuit in fluid communication with the reservoir for providing hydraulic fluid to a transmission device; and wherein at least one of the first hydraulic circuit, the second hydraulic circuit, and the third hydraulic circuit comprises a fluid conditioning device.

19. A hydraulic circuit comprising:

a means for providing pressurized hydraulic fluid to a tilt-trim device;

a means for providing pressurized hydraulic fluid to a power steering device; a means for providing pressurized hydraulic fluid to a transmission device a common reservoir in fluid communication with the means for providing pressurized hydraulic fluid to a tilt-trim device, the means for providing pressurized hydraulic fluid to a transmission device, and the means for providing pressurized hydraulic fluid to a power steering device for providing a volume of hydraulic fluid for use in the tilt-trim device and the power steering device.

20. The hydraulic circuit of claim 19 further comprising a fill vessel disposed at a high point in the hydraulic circuit and in fluid communication with the reservoir.

21. The hydraulic circuit of claim 19 further comprising a means for cooling the hydraulic fluid in the reservoir.

22. The hydraulic circuit of claim 19 further comprising a means for filtering the hydraulic fluid in the reservoir.

23. A pressurized fluid supply apparatus for a water craft comprising:

a common reservoir for containing a volume of hydraulic fluid the common reservoir in fluid communication with a first reservoir and a second reservoir;

a first hydraulic circuit in fluid communication with the first reservoir for providing hydraulic fluid to a power steering device;

a second hydraulic circuit in fluid communication with the second reservoir for providing hydraulic fluid to a tilt-trim device; and a fill vessel device in fluid communication with the common reservoir, the first reservoir, and the second reservoir, the fill vessel configured to maintain a volume indicative of a total hydraulic fluid volume of the pressurized fluid supply apparatus.

24. The pressurized fluid supply apparatus of claim 23 wherein at least one of the first hydraulic circuit and the second hydraulic circuit comprises a fluid conditioning device.

25. The pressurized fluid supply apparatus of claim 24 wherein the conditioning device comprises a cooler.

26. The pressurized fluid supply apparatus of claim 24 wherein the conditioning device comprises a filter.

27. The pressurized fluid supply apparatus of claim 23 further comprising a third hydraulic circuit in fluid communication with the reservoir for providing hydraulic fluid to a transmission device.

28. The pressurized fluid supply apparatus of claim 27 wherein at least one of the first hydraulic circuit, the second hydraulic circuit and the third hydraulic circuit comprises a fluid conditioning device.

29. The pressurized fluid supply apparatus of claim 28 wherein the conditioning device comprises a cooler.

30. The pressurized fluid supply apparatus of claim 28 wherein the conditioning device comprises a filter.

31. The pressurized fluid supply apparatus of claim 28 wherein the reservoir comprises a portion of a transmission housing.

32. A method of conditioning hydraulic fluid for a plurality of hydraulic circuits of a marine craft, the method comprising the steps of:

providing a plurality of hydraulic fluid reservoirs;

providing a common reservoir in fluid communication with the plurality of hydraulic fluid reservoirs;

providing a plurality of hydraulic circuits of a water craft in fluid communication with the common reservoir;

providing a conditioning device in at least one of the hydraulic circuits to condition the hydraulic fluid passing through the at least one of the hydraulic circuits;

returning the conditioned hydraulic fluid to the common reservoir for use in other of the plurality of hydraulic circuits.

33. The method of claim 32 further comprising the step of providing a cooler in the at least one of the hydraulic circuits to remove heat from the hydraulic fluid passing through the at least one of the hydraulic circuits.

34. The method of claim 32 further comprising the step of providing a filter in the at least one of the hydraulic circuits to remove particulate matter from the hydraulic fluid passing through the at least one of the hydraulic circuits.

35. The method of claim 32 further comprising the steps of:

providing a fill vessel in fluid communication with the common reservoir; and maintaining a predetermined level of hydraulic fluid in the fill vessel to provide an adequate supply of hydraulic fluid to the plurality of hydraulic circuits of the water craft.

36. A method of maintaining proper hydraulic fluid levels in a plurality of hydraulic circuits of a water craft, the method comprising the steps of:

providing a common reservoir in fluid communication with a transmission pump, a power steering pump, and a trim pump of a water craft;

providing a common fill vessel in fluid communication with the common reservoir;

locating the fill vessel at a location on the water craft accessible by an operator;

maintaining a level of hydraulic fluid in the fill vessel within a predetermined range of levels to provide an adequate supply of hydraulic fluid to the transmission pump, the power steering pump, and the trim pump.

37. The method of claim 36 further comprising the step of providing a means for cooling the hydraulic fluid in one of the plurality of hydraulic circuits.

38. The method of claim 36 further comprising the step of providing a means for cleaning the hydraulic fluid in one of the plurality of hydraulic circuits.

* * * * *

UNITED STATES PATENT AND TRADEMARK OFFICE

CERTIFICATE OF CORRECTION

PATENT NO. : 6,416,370 B1
DATED : July 9, 2002
INVENTOR(S) : Bland, G. et al.

It is certified that error appears in the above-identified patent and that said Letters Patent is hereby corrected as shown below:

Column 1,
Line 10, insert -- hydraulic systems of watercraft: -- after "various";

Column 7,
Lines 1, 5, 8, 41 and 45, delete "stem" and substitute therefore -- stern --;

Column 8,
Lines 7, 8, 9 and 12, delete "stem" and substitute therefore -- stern --;

Signed and Sealed this

Nineteenth Day of November, 2002

*Attest:*

*Attesting Officer*

JAMES E. ROGAN
*Director of the United States Patent and Trademark Office*